US008677588B2

(12) United States Patent
Soller

(10) Patent No.: US 8,677,588 B2
(45) Date of Patent: Mar. 25, 2014

(54) RIVET SETTING TOOL

(75) Inventor: Daniel Soller, Rickenbach (CH)

(73) Assignee: Wuerth International AG, Chur (CH)

( * ) Notice: Subject to any disclaimer, the term of this patent is extended or adjusted under 35 U.S.C. 154(b) by 0 days.

(21) Appl. No.: 13/818,158

(22) PCT Filed: Aug. 23, 2011

(86) PCT No.: PCT/EP2011/064456

§ 371 (c)(1),
(2), (4) Date: Mar. 13, 2013

(87) PCT Pub. No.: WO2012/025520

PCT Pub. Date: Mar. 1, 2012

(65) Prior Publication Data

US 2013/0212849 A1 Aug. 22, 2013

(30) Foreign Application Priority Data

Aug. 24, 2010 (DE) ..... 10 2010 039 666

(51) Int. Cl.
*B21J 15/00* (2006.01)
*B21D 9/05* (2006.01)

(52) U.S. Cl.
USPC ..... 29/243.525; 29/243.521; 29/243.523; 72/391.4; 72/391.6

(58) Field of Classification Search
USPC ..... 29/243.521, 243, 523, 243.524, 29/243.525, 243.529, 243.523; 72/391.4, 72/391.6
See application file for complete search history.

(56) References Cited

U.S. PATENT DOCUMENTS

| | | | | |
|---|---|---|---|---|
| 2,336,058 | A | 12/1943 | Bettington | |
| 3,626,745 | A | 12/1971 | Richardson et al. | |
| 5,960,667 | A | 10/1999 | Hylwa et al. | |
| 6,182,345 | B1 * | 2/2001 | Travis | 29/243.521 |
| 6,834,420 | B1 | 12/2004 | Röthe et al. | |

* cited by examiner

*Primary Examiner* — David B Jones
(74) *Attorney, Agent, or Firm* — Boyle Fredrickson, S.C.

(57) ABSTRACT

A rivet setter has a holder for holding a blind rivet prior to said rivet being set by means of the setter. The holder has a central cylindrical passage, the diameter of which is somewhat greater than the diameter of the mandrel. At least two, preferably three clamping jaws, which are guided in radial slots so as to be radially and axially displaceable, act on the mandrel. The width of the slot is smaller than the diameter of the mandrel.

12 Claims, 4 Drawing Sheets

RIVET SETTING TOOL

The invention proceeds from a rivet setter, by means of which a blind rivet is able to be set.

Blind rivets are those rivets which are inserted and deformed from the front side without access being available to the rear side of the place where the rivet is being set. The deforming of the blind rivet to form a rivet head on the rear side or in a solid material occurs by means of a mandrel, on which is pulled. This can occur by means of manually actuated pliers, or by means of blind riveters which have a drive. Once the blind rivet has been set, the mandrel breaks off.

Rivet setters also exist which, by means of thrust engagement with the mandrel, drive the rivet into the material to be fastened before, by means of pulling engagement with the mandrel, they deform the rivet for forming a rivet head.

A blind riveter is already known where a pulling device, which pulls on the mandrel of a blind rivet held in the setter, is actuated by means of an electric motor. A collet, which has an inner cone and as a result acts on clamping jaws inwardly, is provided to pull on the blind rivet.

Clamping jaws for engaging with cylindrical objects are known. They are moved in an axial manner and, on account of oblique faces, are also moved inward. Usually, at least two such clamping jaws are present which, whenever they are moved inward, reduce the spaces between one another. First of all, in order to drive in a rivet by means of thrust engagement with the mandrel, the clamping jaws have to be moved outward in order to release the mandrel. The clamping jaws, however, are not guided in the circumferential direction in their state releasing the mandrel and a space is formed between them. The inventor of the present invention has discovered that such enlargements of slots can occur between clamping jaws and that the mandrel can buckle during the setting operation into such a slot. This leads to the setter being completely blocked.

The object underlying the invention is to create a rivet setter which operates in a reliable manner even after being used over a long period and in difficult conditions.

To achieve this object the invention proposes a rivet setter with the features named in claim 1. Further developments of the invention are the object of sub-claims.

The rivet setter proposed by the invention has, therefore, a holder for the mandrel which is realized in such a manner or guides the mandrel in such a manner that lateral deflection of the mandrel is prevented. For this purpose, the holder is developed such that it is substantially closed in the circumferential direction in particular on the end which faces the ram, that is to say any possible spaces are arranged such that the mandrel is not able to penetrate, for example because they are located close to the rivet sleeve, or because they are smaller in the circumferential direction than the diameter of the mandrel.

In a further development of the invention, it can be provided that the holder for the mandrel has at least two radial slots in which in each case a clamping jaw is guided with a small amount of play so as to be radially displaceable. When the clamping jaws are moved radially outward to release the mandrel, the holder continues to guide the mandrel. The slots for the clamping jaws have a width which is smaller than the diameter of a mandrel of a rivet to be set, for example a width of 1-1.5 mm with a mandrel diameter of 2.8 mm.

The clamping plates are arranged with a sliding fit in the slots and consequently have a corresponding width.

In a further development of the invention it can be provided that the rivet setter has a thrust device for setting the rivet, said thrust device includes a ram which engages with the free end of the mandrel arranged in the cylindrical passage.

As claimed in the invention, in a further development the holder for the mandrel can be realized in such a manner that the passage also surrounds the free end of the ram of the thrust device.

The diameter of the passage in the holder for the mandrel is preferably slightly larger than the diameter of the mandrel such that the mandrel is guided in a reliable manner. The passage can consequently also form a guide for the ram. The ram has a diameter which is approximately the same as the diameter of the mandrel.

In another further development of the invention, it can be provided that the clamping jaws are guided in the slots with a small amount of play so as also to be movable in an axially defined manner. Said axial displacement of the clamping jaws can be utilized for the purpose of pushing them by means of compression forces in the axial direction out of engagement with the mandrel.

As claimed in the invention, the slots can be distributed evenly in the circumferential direction, preferably three slots being provided.

In a further development of the invention, the pulling device, which is necessary for setting the rivet, in the region of its front end which is associated with the holder for the rivet to be set, has a clamping sleeve with an inner cone which widens in the pulling direction, by way of which said clamping sleeve abuts against the outer surface of the clamping jaws.

In order to be able to abut the clamping jaws securely against the mandrel by means of the clamping sleeve, as claimed in the invention in a further development, a compression spring can be provided which preferably, by means of a jaw closing means which abuts against the clamping jaws, acts upon the latter in the axial direction in the direction of the end of the pulling device which is associated with the holder for the blind rivet.

The jaw closing means can be a sleeve. The jaw closing means can preferably be guided so as to be axially displaceable on the holder for the blind rivet.

It can be provided, in particular, that the front edges of the slot which face the holder for the rivet extend obliquely in the holder in such a manner that when the clamping jaws are displaced axially, they are also moved radially.

Further features, details and advantages of the invention are produced from the claims and the abstract, the wording of both of which by reference is made part of the contents of the description, from the following description of preferred embodiments of the invention as well as by way of the drawing, in which:

Figure 1:
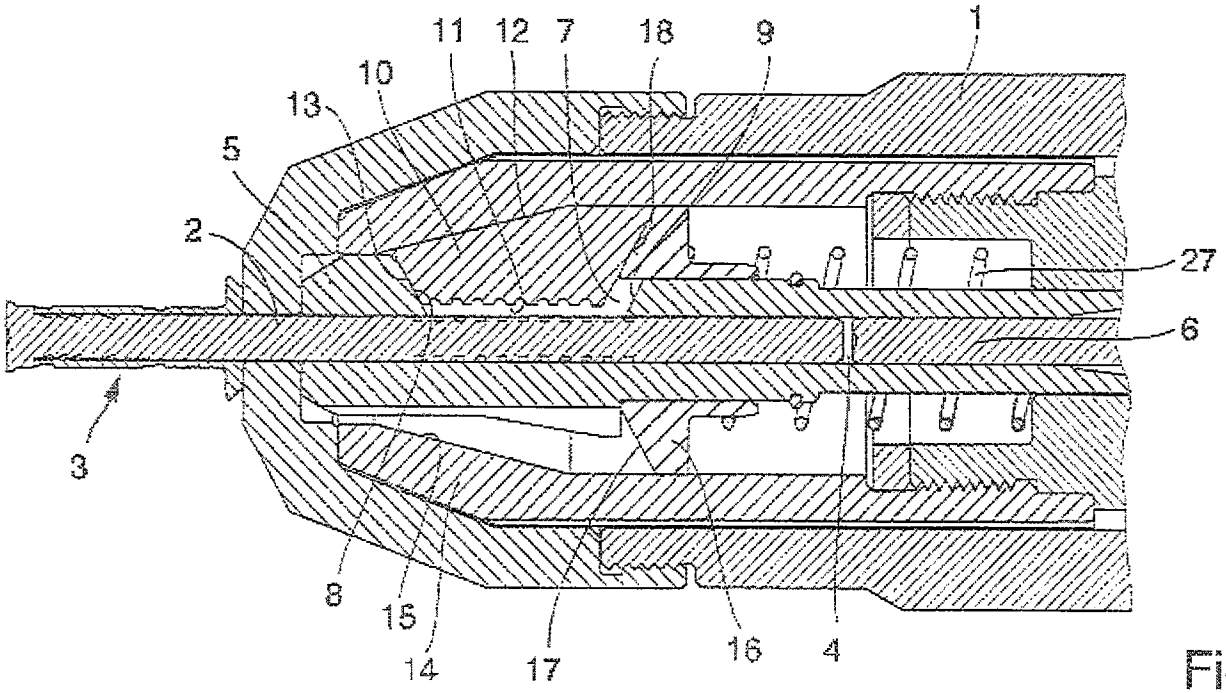
FIG. 1 shows an axial section through the front region of a rivet setter proposed by the invention.

The rivet setter shown in section in FIG. 1 includes a housing 1 which is assembled from several parts. On the front end, on the left in FIG. 1, there is an opening through which the mandrel 2 of a blind rivet 3 is guided. The mandrel 2 extends right into the passage 4 of the holder 5 for the blind rivet 3.

The holder 5 for the blind rivet is arranged in the housing directly behind the opening for the mandrel 2. It extends right into the housing. The already mentioned passage 4, consequently, also receives the ram 6 of the setting device.

The holder 5 for the mandrel 2 has several radial slots 7, of which the section in FIG. 1 shows one such slot 7. The front end wall 8 of the radial slot 7 in the direction of the blind rivet 3 extends in an oblique manner from inside to outside, in the same way as the rear end wall 9. The two end walls 8, 9 diverge outward.

A clamping jaw 10 is guided in the radial slot 7 so as to be displaceable in the radial direction and in the axial direction. The clamping jaw 10 has an inner surface 11 which is provided with rounded teeth and extends approximately parallel to the axis of the mandrel 2. There is an outer surface 12 which faces away from the inner surface 11 and extends in an oblique manner, the dimension of the clamping jaw 10 measured in the radial direction increases from the front side 17 of the setter toward the rear, on the left in FIG. 1. The front edge 13 of the clamping jaw 10 extends in a complementary manner to the front edge 8 of the slot 7.

Both the holder 5 for the rivet and the clamping jaw 10 are surrounded by a clamping sleeve 14 which, on its inner surface 15, has a funnel shape which opens to the right. The clamping sleeve 14 abuts against the outer surface 12 of the clamping jaw 10 by way of said inner surface 15.

A jaw closing means 16, which is acted upon by a compression spring 27 in the direction of the clamping jaw 10, is mounted on the holder 5 for the mandrel. The jaw closing means 16 has a front side 17 which forms an obliquely extending cone face. The jaw closing means 16 cooperates with the complementarily formed rear edge 18 of the clamping jaw 10 by way of said front side 17. The jaw closing means 16 is loaded against the clamping jaw 10 by the compression spring 27 and presses said clamping jaw against the front edge 13 of the slot 7. As a result, the clamping jaws 10 are loaded as far outward as the clamping sleeve 14 allows. If the clamping sleeve 14 is pulled to the right, the clamping jaw 10 is displaced radially inward and as a result is clamped on the mandrel 2.

If, contrary to this, the pulling device, which acts on the clamping sleeve 14, is not actuated such that the clamping sleeve 14 assumes its end position shown in FIG. 1, the clamping jaws 10 are moved out of engagement with the mandrel 2.

Figure 2:
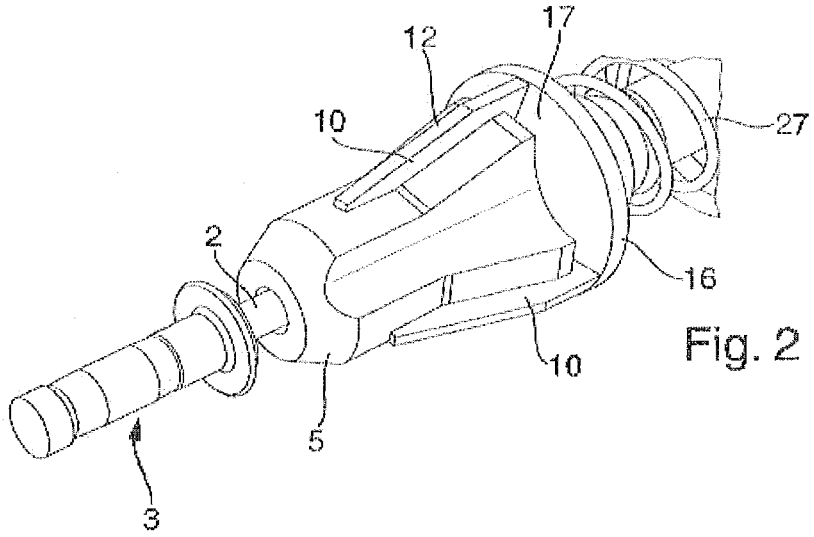
FIG. 2 shows a perspective view of the front region of the holder for the blind rivet.

FIG. 2, to which reference is now made, shows the holder 5 for the mandrel with a mandrel 2 inserted. The outer surfaces 12 of the clamping jaws 10 protrude out of the radial outer surface of the holder. The jaw closing means 16 abuts against the rear end of the clamping jaws 10 by way of its end face 17. It can be seen here that the clamping jaws 10 are secured by the slot in the holder for the mandrel such that they are only able to move in the radial direction and slightly in the axial direction, but not in the circumferential direction.

Figure 3:
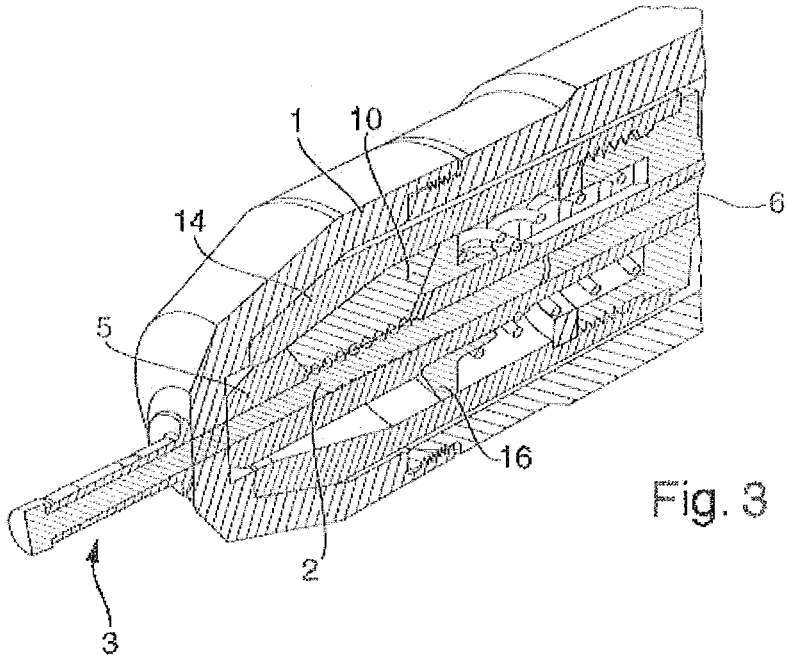
FIG. 3 shows a perspective sectional view of the front region of the rivet setter.

FIG. 3 then shows a perspective representation of a longitudinal section. The representation corresponds approximately to the section in FIG. 1.

Figure 4:
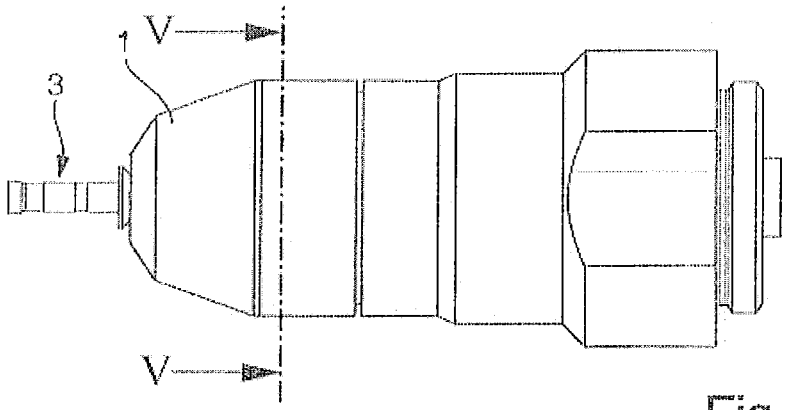
FIG. 4 shows a side view of the front region of the rivet setter.

FIG. 4 shows a side view of the front region of the rivet setter, the axial extension corresponding approximately to FIG. 1.

Figure 5:
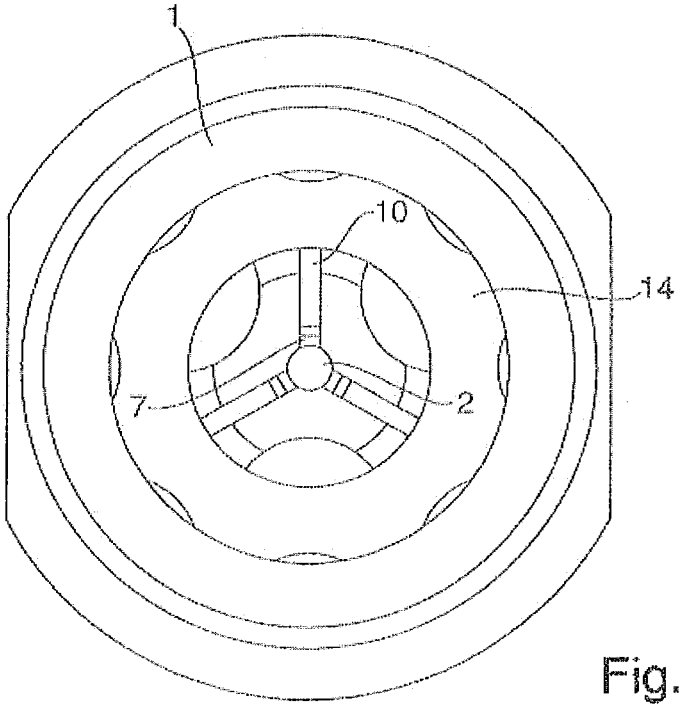
FIG. 5 shows a section along the line V-V in FIG. 4.

FIG. 5 then shows a cross section through the setter approximately along the line V-V in FIG. 4. It can be seen particularly clearly here that the clamping jaws 10 are arranged in the slots 7 which have parallel side walls. The thickness of the clamping jaws 10 corresponds to the width of the slot 7. As a result, the clamping jaws are secured in the circumferential direction. The width of the slot is smaller than the diameter of the mandrel 2. Even in the case of an abrupt impingement on the mandrel 2 in the axial direction by the ram 6, the mandrel is not able to deflect laterally. It is guided in a reliable and secure manner by the holder 5. Said guiding also applies to the ram 6 as said ram 6 is also arranged in the passage 4, see FIG. 1.

Figure 6:
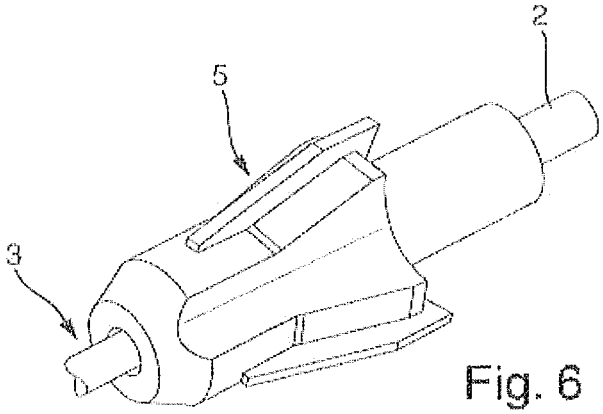
FIG. 6 shows a perspective view of the holder with a rivet inserted.

FIG. 6 shows the holder 5 with the clamping jaws 10 guided therein as well as a blind rivet 3 guided therein. The holder 5 can be divided into a front portion which guides the clamping jaws 10 and into a rear portion, the cylindrical region which connects thereto and is separated by a transition shoulder. The rear portion serves for guiding the mandrel and its length is adapted to the mandrel 2 in order to ensure the guiding of the same in a secure manner. The wall thickness of the rear portion can be reduced to a thickness which is sufficient for the guiding function of the mandrel 2. The rear portion can have slots which extend in the longitudinal direction, the width thereof having to be smaller than the diameter of the mandrel 2 in order to ensure secure guiding of the mandrel 2.

The front and the rear portion of the guide 5 are formed integrally with one another in the present case, but can also be present as separate parts, if the application so demands.

The holder 5 is formed from a solid material in the present case, but can have spaces in addition to the slots 7. Said spaces should, however, be developed such that they do not endanger the guiding of the mandrel 2. This can be realized, for example, in that the spaces are smaller in the circumferential direction than the diameter of the mandrel, as a result of which the penetration of the mandrel 2 into such a space is prevented. This can also be realized, however, in that the spaces are formed in the front, for example between the clamping jaws 10, such that the guiding of the mandrel 2 is not touched by the spaces.

The holder 5 consists of metal in the present case and is produced in the present case as a molded part. The substantially cylindrical form, of the holder 5 makes simple guiding of the holder in the housing 1 possible. However, other forms are equally possible, for example a square or triangular form.

Figure 7:
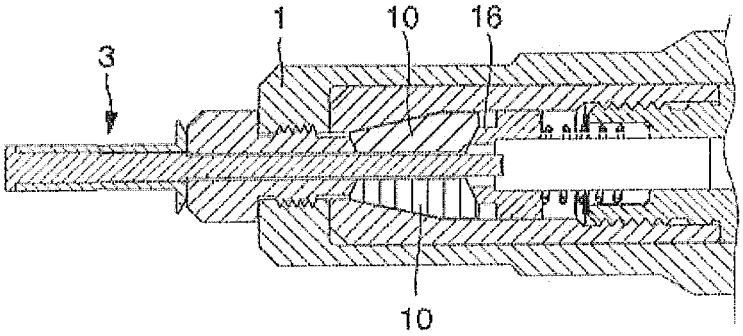
FIG. 7 shows a longitudinal section through the front part of a rivet setter as claimed in another embodiment.

FIG. 7 shows a further embodiment of a front end of a rivet setter into which a rivet 3 is inserted. The clamping jaws are not realized in a plate-shaped manner, as described beforehand, but extend in each case, when viewed in the longitudinal direction, by an angle of 180° such that when the rivet is set the mandrel 2 is gripped completely extensively. The clamping jaws are moved toward one another by means of a clamping sleeve in order to grip the mandrel and to set the rivet, and are subsequently moved apart from one another again by a jaw closing means 16 in order to release the broken mandrel. In the present case, a space is formed radially between the jaw closing means 16 and the free end of the mandrel 2, in which space the rear portion, that is the cylindrical portion, of the holder 5, described beforehand in particular in FIG. 6, can be arranged in order to guide the mandrel 2.

The invention claimed is:

1. A rivet setter, having a holder (5) for the mandrel (2) of the rivet (3) to be set, at least two clamping jaws (10), which are guided so as to be radially displaceable and include a radial inner surface (11) formed for engagement with the mandrel (2) and a radial outer surface (12) formed at an oblique angle to the radial inner surface, as well as having a pulling device, which has a drive for pulling engagement with the mandrel (2) of the rivet (3), the rivet being arranged in the holder, and is formed for engagement with outer surfaces (12) of the clamping jaws (10), wherein the mandrel (2) is secured against lateral deflection in the holder (5) even when released by the clamping laws (10), where the holder (5) for the mandrel (2) has a central cylindrical passage (4) for the mandrel (2) and at least two radial slots (7), a width of which is smaller than a diameter of the passage (4), wherein a clamping jaw (10) is arranged in each slot (7).

2. The rivet setter as claimed in claim 1, having a thrust device for setting the rivet (3), said thrust device has a ram (6) which engages with the free end of the mandrel (2) arranged in the cylindrical passage (4).

3. The rivet setter as claimed in claim 2, where the end of the passage (4) facing the ram (6), with the rivet inserted, extends at least up to 5 mm in front of the end of the mandrel.

4. The rivet setter as claimed in claim 2, where the end of the passage (4) facing the ram (6), with the rivet inserted, extends up to the end of the mandrel.

5. The rivet setter as claimed in claim 2, where the end of the passage (4) facing the ram (6), with the rivet inserted, extends over the end of the mandrel.

6. The rivet setter as claimed in claim 2, where the end of the passage (4) facing the ram (6), with the rivet inserted, extends so as to surround the end of the ram (6) of the thrust device.

7. The rivet setter as claimed in claim 1, where the clamping jaws (10) are guided so as to be movable in an axially defined manner in the slots (7).

8. The rivet setter as claimed in claim 1, where the radial slots (7) are arranged distributed evenly over a circumference of the holder.

9. The rivet setter as claimed in claim 1, where the pulling device has a clamping sleeve (14) proximate to a front end of the pulling device with an inner cone (15) which widens in the pulling direction, by way of which said clamping sleeve abuts against the radial outer surface (12) of the clamping jaws (10).

10. The rivet setter as claimed in claim 1, where a compression spring (27) which acts, in particular, on a jaw closing means (16) which abuts against the clamping jaws (10), is provided for acting upon the clamping jaws (10) in the axial direction.

11. The rivet setter as claimed in claim 10, where the jaw closing means (16) is guided so as to be axially displaceable on the holder (5) for the blind rivet (3).

12. The rivet setter as claimed in claim 1, where the front edges (8) of the radial slot (7) facing the rivet (3) extend in an oblique manner.

* * * * *